US006186652B1

(12) United States Patent
Fadel

(10) Patent No.: US 6,186,652 B1
(45) **Date of Patent: *Feb. 13, 2001**

(54) MOTOR VEHICLE HEADLAMP HAVING A REFLECTOR GIVING SELECTIVE LIGHT DEVIATION, AND METHODS OF MAKING SUCH A REFLECTOR

(75) Inventor: Kamislav Fadel, Pantin (FR)

(73) Assignee: Valeo Vision, Bobigny Cedex (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/623,974

(22) Filed: Mar. 29, 1996

(30) Foreign Application Priority Data

Mar. 31, 1995 (FR) ..... 95 03861

(51) Int. Cl.[7] ..... F21V 7/04
(52) U.S. Cl. ..... 362/518; 362/297; 362/346
(58) Field of Search ..... 362/297, 346, 362/517, 518, 348, 350

(56) References Cited

U.S. PATENT DOCUMENTS

| | | | | |
|---|---|---|---|---|
| 1,572,853 | * | 2/1926 | Balsillie | 362/346 |
| 1,621,752 | | 3/1927 | Raynolds . | |
| 2,108,286 | * | 2/1938 | Godley | 362/346 |
| 3,511,983 | * | 5/1970 | Dorman | 362/297 |
| 4,351,018 | * | 9/1982 | Fratty | 362/346 |
| 5,577,833 | * | 11/1996 | English et al. | 362/518 |

FOREIGN PATENT DOCUMENTS 2 054 815 2/1981 (GB) .

OTHER PUBLICATIONS

French Search Report dated Jan. 19, 1996.

* cited by examiner

*Primary Examiner*—Thomas M. Sember
(74) *Attorney, Agent, or Firm*—Morgan & Finnegan, L.L.P.

(57) ABSTRACT

A motor vehicle headlamp comprises a light source of predetermined geometry, and a reflector associated with the light source. The reflector is made by a method that includes the steps of:

(a) establishing a reflective base surface having a reference focus and giving a predetermined distribution of the light emitted by a light source having a given geometry and a given position with respect to the reference focus, mainly in the vertical direction, (b) in at least one zone, determining a line passing through all of the points that give the same predetermined horizontal deviation of a theoretical radiation propagated from the reference focus, (c) modifying the base surface so as to put on it, substantially along the line determined in step (b), a striation for horizontal diffusion of the light, (d) making a mould in conformity with this modified surface, and (e) moulding the reflector in this mould.

17 Claims, 4 Drawing Sheets

MOTOR VEHICLE HEADLAMP HAVING A REFLECTOR GIVING SELECTIVE LIGHT DEVIATION, AND METHODS OF MAKING SUCH A REFLECTOR

FIELD OF THE INVENTION

The present invention relates in general terms to motor vehicle headlamps, and more particularly to motor vehicle headlamp reflectors and a new method of making such a reflector. The term "headlamp" is used herein in a general sense, for any lamp of the vehicle used to illuminate the road or environment of the vehicle when the vehicle is moving.

BACKGROUND OF THE INVENTION

Reference is made first to a number of prior art patent specifications, in the name of the present Applicant or the Applicant in the French application from which priority is claimed in the present case. Notable among these prior art specifications are those of the French documents FR 2 536 502A, FR 2 536 503A, FR 2 583 139A, FR 2 599 120A, FR 2 599 121A, FR 2 600 024A, FR 2 602 305A, FR 2 602 306A, and FR 2 694 373A.

In the prior art represented variously by the above mentioned documents, a motor vehicle headlamp reflector is known which is capable, by cooperating with a generally cylindrical light source which emits light freely all around it, of generating a beam which is delimited by a straight cut-off line at the top or bottom of the beam. By judicious combination of this kind of surface, it is possible to make reflectors which emit beams satisfying various photometric criteria, and in particular, cruising beams and beams for penetrating fog.

It is also known, especially from the further French specifications (in the name of the same Applicant) FR 2 609 146A, FR 2 609 148A, FR 2 639 888A and FR 2 664 677A, to provide reflectors of a second type. In this second type the surfaces are so designed as to provide, as a general rule, the same type of cut-off, while offering beams which are of substantial width and are highly homogeneous. As a result, it is possible to have recourse to headlamp cover glasses which are smooth or only very slightly striated. Such cover glasses are advantageous, both from the optical point of view and from the aesthetic point of view, because the beam which is produced by the single reflector is able to have all the required qualities.

However, the design of that type of reflector does have certain limitations, and in particular it involves, generally, tackling the question of the width of the beam. Thus, with reflectors of the above mentioned second type, it is extended regions of the reflector that, in general, determine the width of the beam.

DISCUSSION OF THE INVENTION

An object of the present invention is to overcome this limitation, and to enable the design of reflectors giving automatic generation of cut-off, and more generally, the design of any type of reflector for a motor vehicle headlamp, to be made more flexible by enabling predetermined portions of the beam, well localised, to affect beam width without disturbing the remainder of the reflector.

Another object of the present invention is, by taking advantage of this increased flexibility of design, to provide reflectors that are capable of propagating beams which are more comfortable for drivers, and in particular, beams which are more homogeneous and better balanced as regards the factors of beam width and zone of light concentration along the axis of travel or close to that axis.

According to the invention in a first aspect, a method of making a motor vehicle headlamp reflector, is characterised in that it includes the steps consisting of:

(a) establishing a reflective base surface having a reference focus and adapted to give a predetermined distribution of the light emitted by a light source having a given geometry and a given position with respect to the said reference focus, mainly in the vertical direction, (b) in at least one zone of the reflective surface, determining a line passing through all of the points that give the same predetermined horizontal deviation of a theoretical radiation propagated from the reference focus, (c) modifying the said reflective base surface so as to put thereon, substantially along the said line, a striation (S) for horizontal diffusion of the light, (d) making a mould in conformity with the said modified surface, and (e) moulding the reflector using the said mould.

According to the invention in a second aspect, a method of making a motor vehicle headlamp reflector, is characterised in that it includes the steps consisting of:

(a) establishing a reflective base surface having a reference focus and adapted to give a predetermined distribution of the light emitted by a light source having a given geometry and a given position with respect to the said reference focus, mainly in the vertical direction, (b) in at least one zone of the reflective surface, determining two lines passing through two sets of points that give, respectively, two horizontal deviations, which are constant and close to each other, of a theoretical radiation propagated from the reference focus, (c) modifying the said reflective base surface so as to put thereon, in a band delimited by the said two lines, a striation for horizontal diffusion of the light, (d) making a mould in conformity with the said modified surface, and (e) moulding the reflector using the said mould.

In either or both of the methods according to the invention defined above, steps (b) and (c) are preferably repeated so as to put a plurality of striations on the reflective surface.

Preferably also, at least some of the striations are adjacent to each other.

According to the invention in a third aspect, a motor vehicle headlamp, of the type comprising a light source having a predetermined geometry, a reflector and a closure glass, is characterised in that the reflector includes at least one striation for the horizontal diffusion of the light, the striation projecting from, or being recessed into, a base surface and extending in a band which is delimited by two lines, with each of these lines, if traced on the said base surface, giving over its whole length an essentially constant horizontal deviation of the light propagated from a reference focus of the said base surface.

Further aspects, objects and advantages of the present invention will appear more clearly on a reading of the following detailed description of preferred embodiments of the invention, which are given by way of non-limiting example only and with reference to the accompanying drawings.

DESCRIPTION OF A PREFERRED EMBODIMENT OF THE INVENTION

Figure 1:
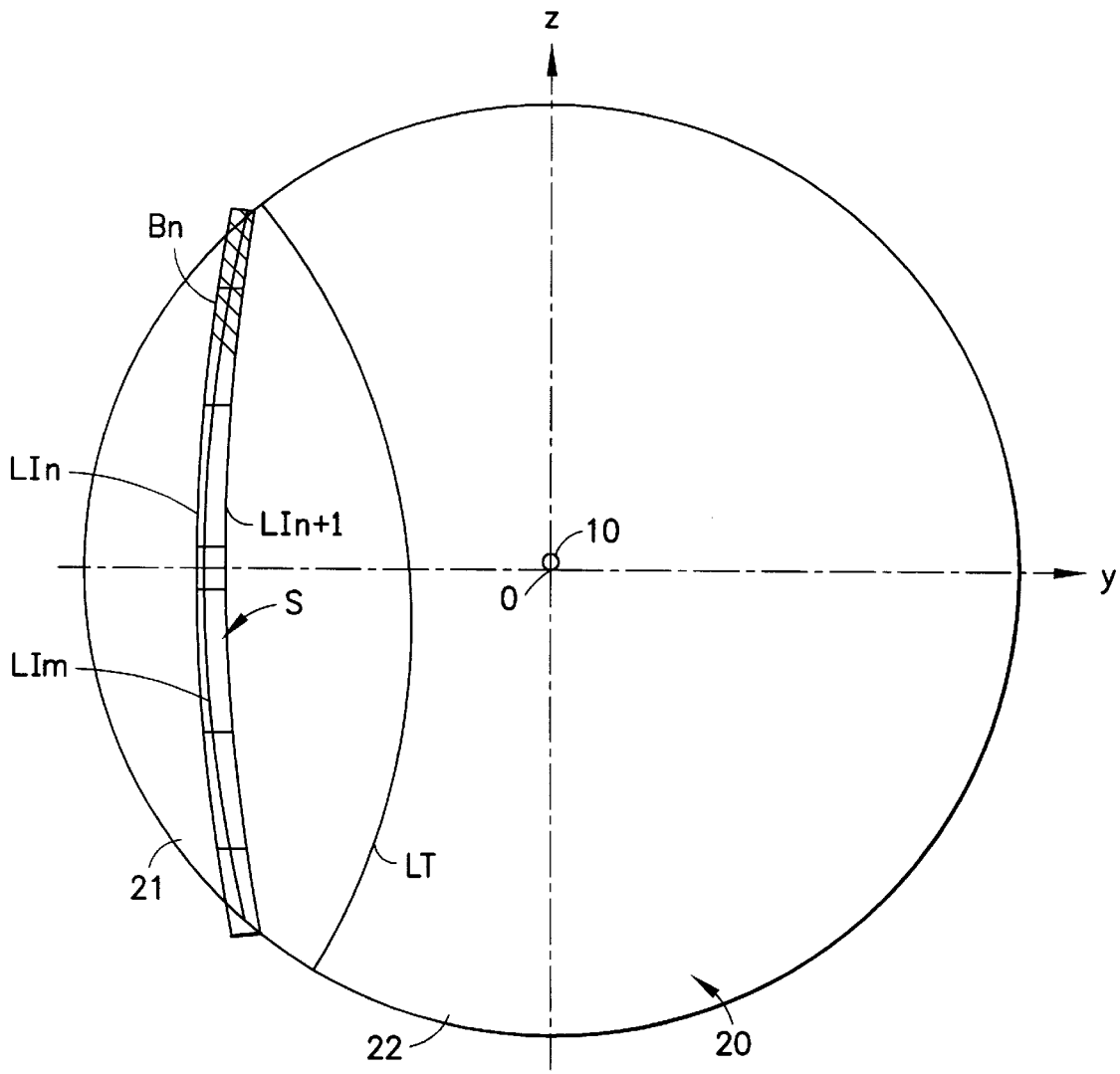
FIG. 1 is a diagrammatic front view of a headlamp reflector for a motor vehicle, on which a striation has been provided for diffusing the light in accordance with the present invention.
Figure 1A:
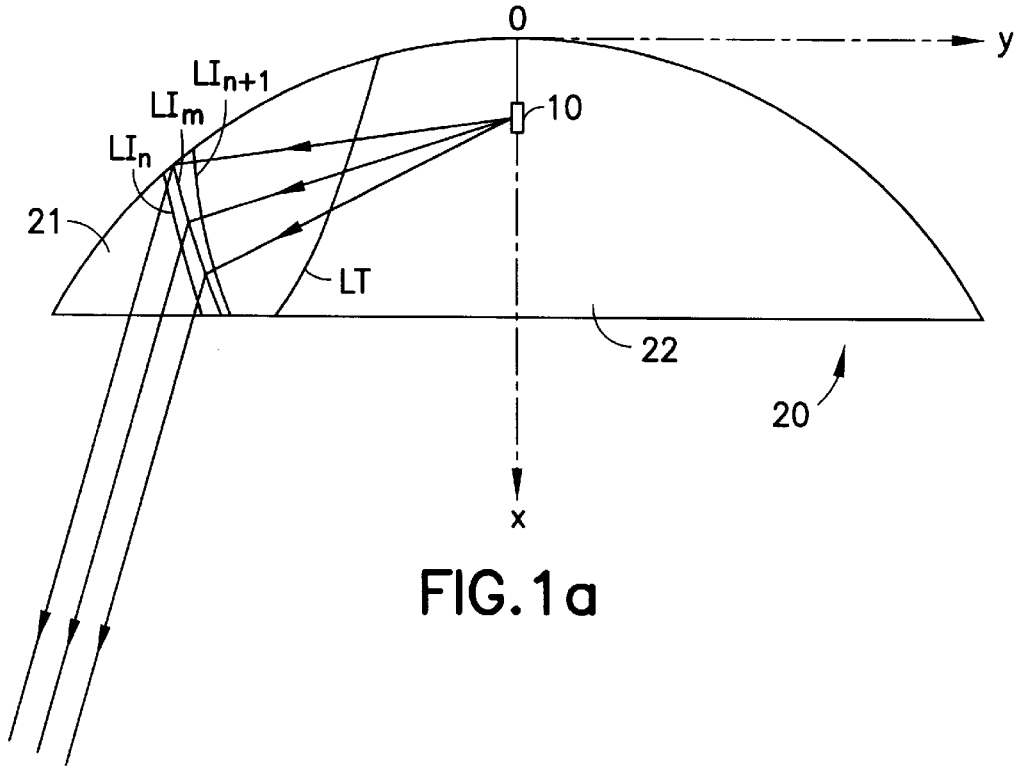
FIG. 1*a* is a diagrammatic sectional top view taken along the Y axis of the headlamp reflector of FIG. 1.

With reference first to FIG. 1, this shows a reflector 20 of a motor vehicle headlamp. In the present case this reflector comprises two zones 21 and 22, which are separated by a curved transition line LT. These zones may for example consist of two surfaces, each of which is designed to generate a part of the light beam which is bounded by a cut-off line, in accordance with one of the documents mentioned in the introduction to this specification. However, the surfaces of the zones 20 and 21 may also be of the parabolic type.

Although FIG. 1 shows a reflector having a circular perimeter, it will be clearly understood that the latter may be truncated, in particular by upper and lower edges, in such a way that it has a generally rectangular aperture.

The reflector is adapted to cooperate with a light source, which in this case is the axial filament 10 of a lamp (not shown complete), so as to generate a beam, and in particular a chopped beam, which has a preselected light distribution.

In the present example, the lateral zone 21 is adapted to receive at least one striation for the selective horizontal diffusion of the light.

In accordance with one feature of the present invention, each of these striations is disposed between two lines of isodeviation of the zone 21 of the reflector. In the present application, the term "line of isodeviation" is to be understood to mean a continuous line which includes all those points on the reflector which, starting from a theoretical radiation or pencil of light emitted from a base or reference focus defined by a reflective base surface of the reflector, all give the same horizontal deviation at the level of the reflected pencil of light. In practical terms, this means that, for an orthogonal projection of the reflected pencil of light on the axial horizontal plane xOy of the three-dimensional reference frame (0,x,y,z), the angle between that projection and the axis 0x is constant. Thus, a line of isodeviation is a line of the reflector where all of the reflected rays have the same horizontal direction.

As to the concept of a base focus, reference should be made to the documents cited in the introduction of this specification, which describe in particular certain mathematical equations, in which one parameter, the base focal distance, determines the position of a base focus. The source 10 always occupies a position which is accurately determined with respect to this base focus.

When the surface of the zone 21 is defined mathematically by such a mathematical equation, the lie, i.e. the form, position and orientation, of an isodeviation line is determined by calculation, using in particular the equation of the plane which is tangential to the surface at the point of reflection concerned, and the equation of the direction corresponding to the incident theoretical pencil of light, in order to determine, first, the equation of the direction of the reflected pencil of light, and then the equation of the orthogonal projection of that direction in the plane x0y.

In a variant, it is of course possible to determine an isodeviation line empirically, using successive optical tests carried out on a grid of points.

In FIG. 1, two successive isodeviation lines are designated as $LI_n$ and $LI_{n+1}$. These correspond respectively to two horizontal angles of deviation $\alpha_n$ and $\alpha_{n+1}$ lying on either side of a median base deviation $\alpha_m$, with:

$$\alpha_m=(\alpha_n+\alpha_{n+1})/2$$

In practice, the lines $LI_n$ and $LI_{n+1}$ are lines which are curved to a greater or lesser extent, but which have a regular appearance where the zone of the reflector under consideration is assumed to have a continuity of order 0 (i.e. there are no jumps), and of order 1 (i.e. there are no slope ruptures). The lines $LI_n$ and $LI_{n+1}$ flank a line $LI_m$ which corresponds to the median base deviation.

These two lines delimit between them a band $B_n$ which is oriented generally vertically. In accordance with the present invention, a striation S, which may be either hollow or in relief, is formed over the whole extent of the band $B_n$ of the reflective surface.

This striation is first modelled in terms of a theoretical radius of curvature, which would have been that of the actual striation if it had been applied orthogonally on a vertical flat surface. In practical terms, this striation is formed on the reflective surface, of known base equation, by adding to the coordinate x of each point on the base surface an offset value which is calculated as a function of, firstly, the theoretical radius of curvature, mentioned above, of the striation, and secondly, the position of that point in the band concerned. In one simple embodiment, a single striation, having a constant radius of curvature and extending over the whole extent of the band, is formed in the band $B_n$. In other embodiments, a plurality of striations may be provided in the zone $B_n$, these striations having radii of curvature which vary either stepwise or progressively.

In addition, if it is desired to modify the vertical position of the light emitted by the band $B_n$, it can be arranged that the striation has a level or height with respect to the base surface which varies along the said band. For example, with a striation the level of which, with respect to the base surface, increases going downwardly, the light generated by the zone $B_n$ is generally raised, apart from the diffusion which is given by the profile of the striation.

Moreover, it is possible to arrange in the band $B_n$ a plurality of striations, each of which has its own characteristics as to radius or radii of curvature and level or levels.

It will be understood that the value of the radius of curvature, in combination with the mean width of the band $B_n$, will determine the degree of horizontal diffusion of the light which is provided by the striation. In addition, the width of the band $B_n$, and therfore that of the striation, is controlled by making an appropriate choice of the above mentioned angles of deviation $\alpha_n$ and $\alpha_{n+1}$. The closer these values are to each other, the narrower will be the striation.

Figure 2:
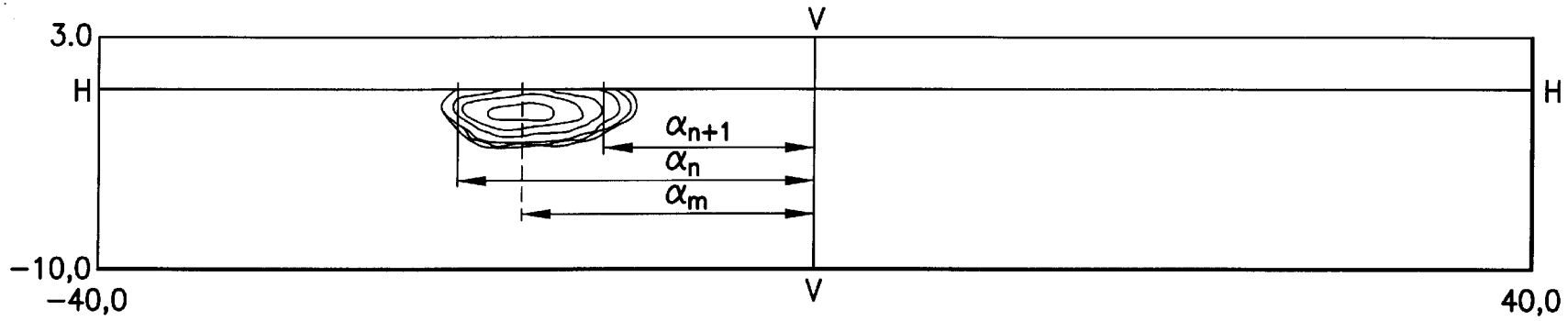
FIG. 2 shows, by means of a set of curves, along each of which the luminous intensity is constant, the light distribution of the part of the beam which is generated by a predetermined zone of the reflector without a striation.

Reference is now made to FIG. 2, which shows the light distribution in that part of the beam which is generated by the zone of the reflector constituted by the band $B_n$ in the absence of a striation. Here the pool of light is relatively small, and is bounded at the top by a horizontal cut-off line which is offset at its centre by the angle $\alpha_m$ with respect to the vertical central reference plane, which is denoted VV in FIG. 2.

Figure 3:
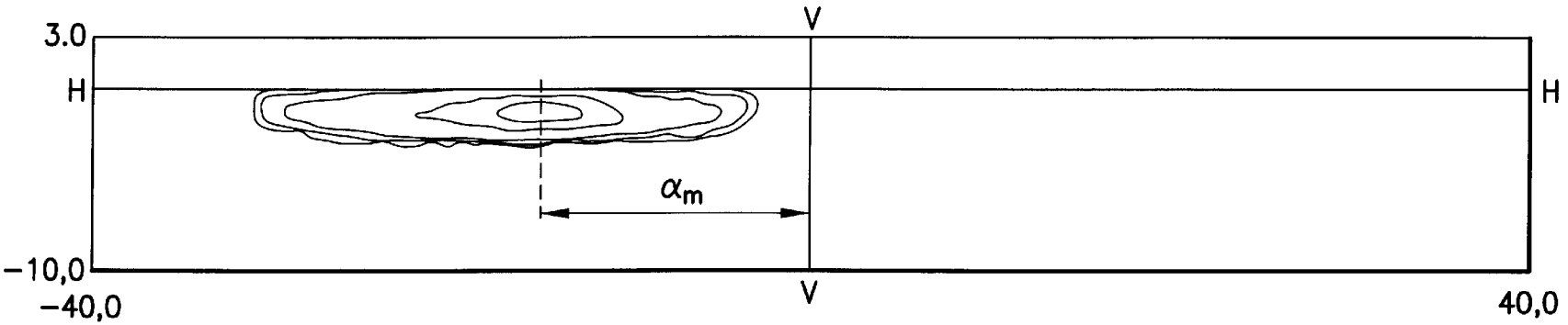
FIG. 3 shows, again by means of a similar set of curves, the light distribution in the part of the beam which is generated by a predetermined zone of the reflector after a striation for diffusing the light has been fitted to the mirror.

FIG. 3 shows the appearance of this pool of light after a striation has been fitted on to the reflector. It is found that the upper horizontal cut-off line is still present, and with excellent definition. It is also found that the light is not displaced downwardly, and that the pool of light is very wide and very homogeneous, while retaining its mean deviation $\alpha_m$.

Figure 4:
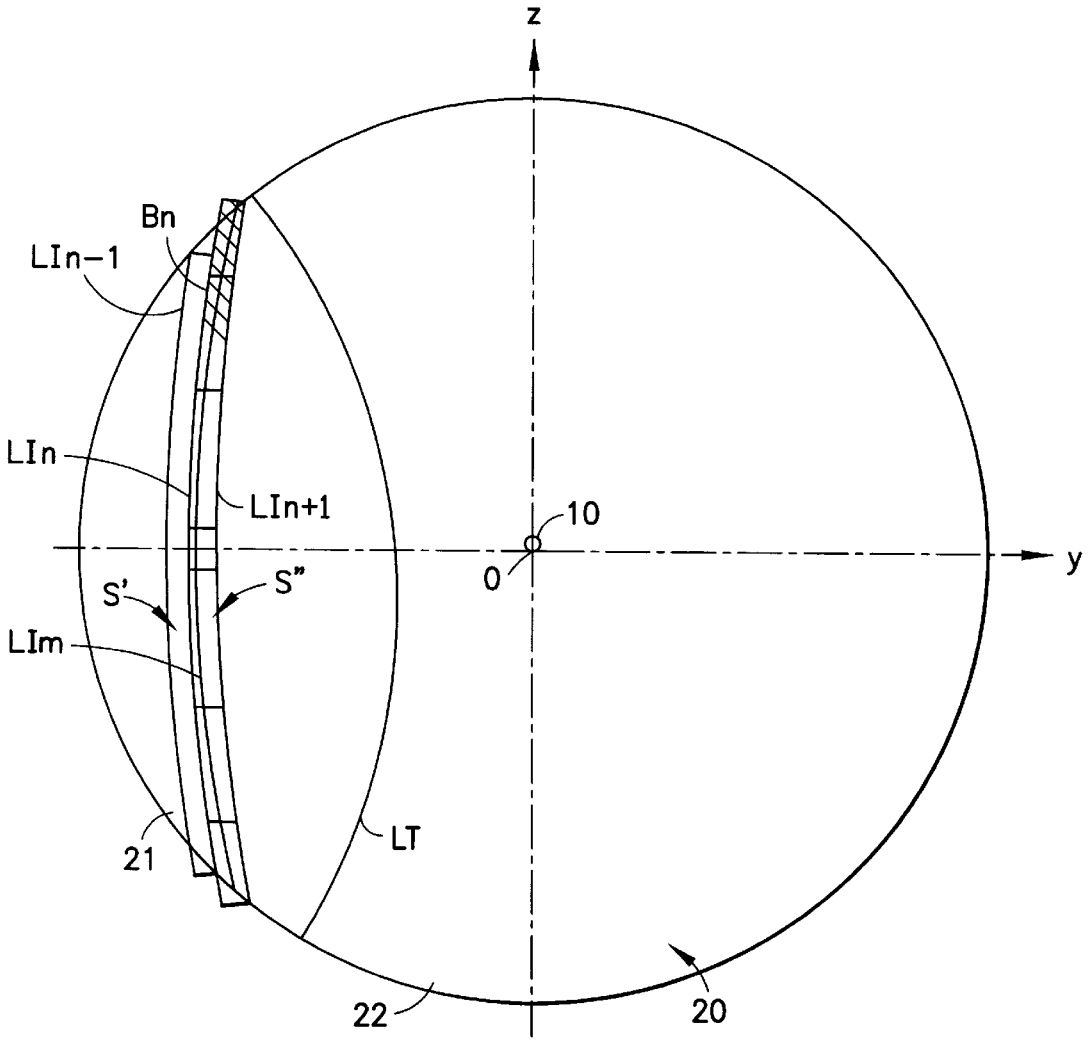
FIG. 4 is a diagrammatic front view of a headlamp reflector for a motor vehicle on which two striations have been provided.

In practice, a plurality of adjacent striations S', S" are provided on at least one zone of the reflector, with two adjacent striations S', S" being joined together along the isodeviation line $LI_n$ that separates them. In this way, the transitions between the striations S', S" are continuous. Such adjacent situations S', S" are shown in FIG. 4.

In addition, in one simplified embodiment of a reflector in accordance with the present invention, a single isodeviation line $LI_k$ is determined, and a striation is formed which is such that its apex follows this line at least approximately. This simplified version is applicable especially when it is desired to have one striation in isolation, so that the question of its being joined continuously with adjacent striations does not arise.

The present invention is of course in no way limited to the embodiments described and shown, but the person skilled in the art will be able to apply to it any variation or modification within the spirit of the invention.

What is claimed is:

1. A method of making a motor vehicle headlamp reflector, the method including the steps of:

obtaining a reflective base surface that is non-parabolic or that includes at least one non-parabolic portion, the reflective base surface generating a predetermined distribution of light emitted from a light source;

determining a line of isodeviation on the non-parabolic portion of the reflective base surface from which a theoretical radiation emitted from the light source is reflected in a distinct horizontal angle of deviation; and providing on the non-parabolic portion of the reflective base surface, substantially along said line of isodeviation, a striation for the horizontal diffusion of light.

2. A method according to claim 1, wherein a plurality of striations are provided on separate lines of isodeviation on the reflective base surface.

3. A method according to claim 2, wherein at least some of said plurality of striations are adjacent.

4. The method of claim 1 further comprising the steps of:

making a mold in conformity with said reflective base surface having said striation; and molding the reflector using said mold.

5. A method of making a motor vehicle headlamp reflector having a reflective base surface that is non-parabolic or at least includes one non-parabolic portion and that generates a predetermined distribution of light emitted from a light source, the method including the steps of:

determining a first line of isodeviation on the non-parabolic portion of the reflective base surface from which a first theoretical radiation emitted from the light source is reflected in a first distinct horizontal angle of deviation;

determining a second line of isodeviation on the non-parabolic portion of the reflective base surface from which said theoretical radiation emitted from the light source is reflected in a second distinct horizontal angle of deviation, wherein said first and second lines of isodeviation define a band on the non-parabolic portion of the reflective base surface; and providing within said band a striation for the horizontal diffusion of light.

6. A method according to claim 5, wherein a plurality of striations are provided on separate lines of isodeviation on the reflective surface.

7. A method according to claim 6, wherein at least some of said plurality of striations are adjacent.

8. The method of claim 5 further comprising the steps of:

(d) making a mold in conformity with said reflective base surface having said striation; and (e) molding the reflector using said mold.

9. A motor vehicle headlamp comprising a light source of predetermined geometry, a reflector adjacent to said light source for reflecting light therefrom, and a closure glass in front of said reflector and said light source, wherein said reflector defines a reflective base surface that is non-parabolic or includes at least one non-parabolic portion and that generates a predetermined distribution of light emitted from said light source, said non-parabolic portion of said base surface further defining a first and a second notional line delimiting a band of said base surface between them, and wherein light reflected from said first notional line is reflected in an essentially first distinct horizontal angle of deviation and light reflected from said second notional line is reflected in an essentially second distinct horizontal angle of deviation, and said reflector further includes at least one striation in said base surface and within said band for horizontal diffusion of light.

10. The headlamp of claim 9 wherein said striation projects from said base.

11. The method of claim 4 further comprising the steps of:

making a mold in conformity with said reflective base surface having said striation; and molding the reflector using said mold.

12. A reflector having a reflective base surface that is non-parabolic or includes at least one non-parabolic portion and that generates a predetermined distribution of light emitted from a light source, the reflector comprising:

at least one line of isodeviation on the non-parabolic portion of the reflective base surface, each said line of isodeviation reflecting radiation emitted from the light source in a distinct horizontal angle of deviation;

a striation on the non-parabolic portion of the reflective base surface, said striation located approximately along one of said lines of isodeviation.

13. The reflector of claim 12 further comprising a plurality of striations, wherein each of said plurality of striations is located approximately along one of a plurality of lines of isodeviation.

14. The reflector of claim 12 further comprising a light source adjacent the reflective base surface and a closure glass positioned so that said light source is interposed between said closure glass and the reflective base surface.

15. The reflector of claim 12 further comprising a second striation located approximately along said one line of isodeviation, wherein said striation and said second striation are joined along said one line of isodeviation.

16. The reflector of claim 12 wherein said striation has a varying height.

17. The reflector of claim 12 wherein said striation is located between said first line of isodeviation and a second line of isodeviation.

* * * * *